US006253593B1

(12) United States Patent
Goto et al.

(10) Patent No.: US 6,253,593 B1
(45) Date of Patent: Jul. 3, 2001

(54) PIERCER ROLL EXCHANGING APPARATUS FOR VERTICAL PIERCING MILL AND PIERCER ROLL EXCHANGING METHOD

(75) Inventors: Hisao Goto; Masaomi Nakamura, both of Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/549,177

(22) Filed: Apr. 13, 2000

Related U.S. Application Data

(63) Continuation of application No. PCT/JP98/04628, filed on Oct. 14, 1998.

(30) Foreign Application Priority Data

Oct. 15, 1997 (JP) ..... 9-281509

(51) Int. Cl.[7] ..... B21B 31/07

(52) U.S. Cl. ..... 72/239; 72/97; 72/238; 72/366.2

(58) Field of Search ..... 72/238, 239, 237, 72/96, 97, 366.2

(56) References Cited

U.S. PATENT DOCUMENTS 3,566,653 * 3/1971 Unrath ..... 72/239
3,577,758 * 5/1971 Adair ..... 72/239
4,387,584 * 6/1983 Akita et al. ..... 72/239
4,449,386 * 5/1984 Akita et al. ..... 72/239

FOREIGN PATENT DOCUMENTS 7-32013 2/1995 (JP) .

* cited by examiner

*Primary Examiner*—Ed Tolan
(74) *Attorney, Agent, or Firm*—Armstrong, Westerman, Hattori, McLeland & Naughton, LLP

(57) ABSTRACT

A piercer roll exchanging apparatus for use in a vertical piercing mill, as well as a piercer roll exchange method for use with the apparatus, which can automate the exchange of piercer rolls and which are suitable for flexible manufacture of small quantities of seamless steel tubes of a variety of sizes. The apparatus comprises a traveling carrier car capable of moving while carrying upper and lower cradles thereon, and a cradle shifter mounted on the traveling carrier car. The cradle shifter shifts the upper and lower cradles from a traveling end position to the interior of a piercing mill body. The cradle shifter includes a spacer clamp for clamping a cradle-to-cradle spacer and for adjusting the vertical position of the spacer, as well as a lower cradle clamp. According to the present invention, automation of piercer roll exchange work and shortening of the exchange time can be attained by means of a simple structure and without deterioration of workability.

7 Claims, 6 Drawing Sheets

PIERCER ROLL EXCHANGING APPARATUS FOR VERTICAL PIERCING MILL AND PIERCER ROLL EXCHANGING METHOD

This application is a continuation of international application PCT/JP98/04628 filed on Oct. 14, 1998.

TECHNICAL FIELD OF THE INVENTION

The present invention relates to an apparatus for exchanging a piercer roll in a vertical piercing mill for the manufacture of seamless steel tubes, as well as to a piercer roll exchange method to be adopted by the apparatus. More particularly, the present invention relates to a piercer roll exchanging apparatus and method for use in a vertical piercing mill, which apparatus and method can automate the exchange of old piercer rolls with new ones, thereby shortening the exchange time, and which can cope with flexible manufacture of small quantities of seamless steel tubes of a variety of different sizes.

BACKGROUND ART OF THE INVENTION

As a method of manufacturing seamless steel tubes under hot working conditions, the Mannesmann tube-making process is widely employed. In this tube-making process, a round billet heated to a high temperature is fed as a material to be rolled into a piercing mill (a so-called "piercer"), which pierces the axial center portion of the round billet to yield a hollow shell. The thus-obtained hollow shell is fed directly, or, as needed, after undergoing an expansion or wall-thinning process in an elongator having the same structure as that of the piercing mill, into a subsequent elongating mill such as a plug mill, a mandrel mill, or the like so as to be elongated. Subsequently, the thus-elongated tube undergoes a finishing process performed by a stretch reducer for shape correction, a reeler for polishing, and a sizer for sizing, thereby being formed into a seamless steel tube product.

FIG. 1 shows the material being pierced and an arrangement of piercing rolls and disk rolls in a piercing mill. Piercing rolls 2, 2 are axisymmetrically arranged so as to form a predetermined feed angle with respect to the pass line X-X along which a round billet 1 serving as the material is rolled. On the other hand, a disk roll 3 is close to and perpendicular to the piercer rolls 2, and opposedly arranged with a material 1 to be rolled to piercing. In the piercing mill with the piercing rolls 2, 2 arranged as above, when the round billet 1 is fed along the pass line X-X in the direction indicated by the illustrated white arrow, the round billet 1 is caught between the piercing rolls 2 and is transferred along the pass line X-X while being rotated, during which the round billet 1 is pierced at its axial center portion by an unillustrated plug so as to become a hollow shell.

A piercing mill which adopts a roll arrangement such that a pair of piercer rolls are arranged one above the other and opposite each other with respect to a pass line is usually called a "vertical piercing mill," and a piercing mill wherein a pair of piercer rolls are arranged one beside the other and opposite each other with respect to a pass line is usually called a "orizontal piercing mill." Recently, the vertical piercing mill has been widely adopted as a seamless steel tube manufacturing apparatus, because of an advantage thereof that changeover work can be performed in a simple manner, as will be described later.

As previously mentioned, since the piercer rolls mounted on the piercer are axisymmetrically arranged so that they are at a predetermined angle and roll-shaped with respect to the material, when a dimension of the material is changed due to the step exchange, it is necessary to exchange the piercer rolls. Further, in the piercer, since the material is processed while pressing down the piercer rolls against the material maintained at a high temperature, the processing surfaces of the rolls are deteriorated as the rolling time passes. To this end also, the piercer rolls are periodically exchanged. Generally, the piercer rolls are received in a cylindrical cradle so that they are supported at a predetermined feed angle and, if necessary cross angle, in which state they are mounted on the rolling mill body. Therefore, the exchange of the piercer rolls is carried out in every cradle.

In exchanging the piercer rolls of the foregoing horizontal piercing mill, a mill housing of the piercing mill must be opened and the cradles must be suspended successively by means of suspension means such as an overhead traveling crane, or the like. In piercer roll exchange work employing suspension means, such as an overhead traveling crane, much time is required for exchanging a pair of piercer rolls and hence a decrease in availability of the piercing mill is unavoidable.

Even the "vertical piercer", if it is the type in which cradles are exchanged in order one-by-one, the roll exchanging work by way of the hanging device, a problem similar to that described above occurs. Therefore, as an improvement of the piercer roll exchange in the vertical piercer, the present inventors have proposed a piercer that can exchange rolls without using the hanging device, for example, in Japanese Patent Application Laid-open (kokai) No. 5-200412. That is, this patent discloses a system in which a swing door of a mill housing for covering the rolling mill body can be turned sideways of a pass line to open the mill housing, and rolls are drawn out in a horizontal lateral direction of a pass line. However, the roll exchange system proposed therein is intended mainly for the exchange of disk rolls, and the above patent application discloses no specific device or construction for exchange of piercer rolls. Therefore, in order to automate the piercer roll exchange work in a piercing mill, the conventional piercer roll exchanging methods must be reviewed, an optimum method must be determined, and a piercer roll exchanging apparatus must be developed on the basis thereof

SUMMARY OF THE INVENTION

The present invention has been accomplished in view of the above-mentioned problems involved in the piercer roll exchange work in a piercing mill for the manufacture of seamless steel tubes, and an object of the invention is to provide a piercer roll exchanging apparatus and method for use in a vertical piercing mill, which apparatus and method employ a simple construction, and can automate piercer roll exchange work, shorten the time required for the same, and cope with flexible manufacture of small quantities of seamless steel tubes of a variety of different sizes, without deteriorating the workability.

The present invention resides in the below-described piercer roll exchanging apparatus (1) for use in a vertical piercing mill, which is shown in FIG. 2, and the below-described piercer roll exchange method (2):

(1) A piercer roll exchanging apparatus for a vertical piercing mill having a pair of piercer rolls together with upper and lower cradles 4*a*, 4*b* which accommodate the respective piercer rolls, and a spacer 5 which adjusts the spacing between the upper and lower cradles. The paired piercer rolls are disposed one above the other and opposite each other with respect to a pass line of a piece of tube stock to be subjected to piercing. The piercer roll exchanging apparatus comprises a traveling carrier car 7 capable of moving between a traveling start position and a traveling end position close to a piercing mill body, and a cradle shifter 8 carried on the traveling carrier car, the cradle shifter 8 being capable of shifting the upper and lower cradles from the traveling end position to the interior of the piercing mill body, the cradle shifter being provided with a spacer clamp 9 for clamping the spacer 5 and adjusting the vertical position of the spacer, and with a lower cradle clamp 10 for clamping the lower cradle, the upper and lower cradles being stacked with the spacer sandwiched therebetween and moved horizontally and perpendicular to the pass line.

In the above piercer roll exchanging apparatus, the traveling carrier car 7 is preferably of a structure such that there can be carried thereon a secondary carrier car 12 which carries thereon cradles accommodating piercer rolls to be newly installed in the piercing mill body, or a secondary carrier car 12 which carries thereon cradles accommodating piercer rolls removed from the piercing mill body. Preferably, the secondary carrier car 12 is loaded onto and unloaded from the traveling carrier car at the traveling start position.

Preferably, the lower cradle damp is a hook mechanism.

(2) A piercer roll exchange method for a vertical piercing mill including a pair of piercer rolls together with cradles 4 which comprise an upper cradle 4*a* and a lower cradle 4*b* stacked on the upper cradle and which accommodate the respective piercer rolls, together with a spacer 5 which adjusts the spacing between the upper and lower cradles, the paired piercer rolls being disposed one above the other and opposite each other with respect to a pass line of a piece of tube stock to be subjected to piercing. In the piercer roll exchange method, when the piercer rolls are installed, the upper and lower cradles are loaded onto a traveling carrier car 7 at a traveling start position, and the traveling carrier car 7 is moved to a traveling end position while allowing a cradle shifter 8 to clamp said spacer. Subsequently, the cradle shifter 8 shifts the upper and lower cradles to the interior of a piercing mill body in order to install the piercer rolls in the piercing mill body as they are accommodated in the cradles. Subsequently, the cradle shifter 8 which damps the spacer 5 is retreated.

Likewise, there also is provided a piercer roll exchange method for use in a vertical piercing mill. When a pair of piercer rolls are removed, a traveling carrier car 7 is moved to a traveling end position while allowing the foregoing spacer to be clamped by means of a cradle shifter 8, and the cradle shifter 8 moves the foregoing upper and lower cradles to the interior of a piercing mill body in order to remove the piercer rolls from the piercing mill body as they are accommodated in the cradles. Subsequently, the stacked upper and lower cradles 4*a*, 4*b* and the spacer 5 are retreated by the cradle shifter 8.

Preferably, in the above piercer roll exchange method, a secondary carrier car 12 which carries thereon the upper and lower cradles with the spacer sandwiched therebetween is loaded onto and unloaded from the traveling carrier car 7 at the traveling start position.

BEST MODE FOR CARRYING OUT THE INVENTION

Figure 1:
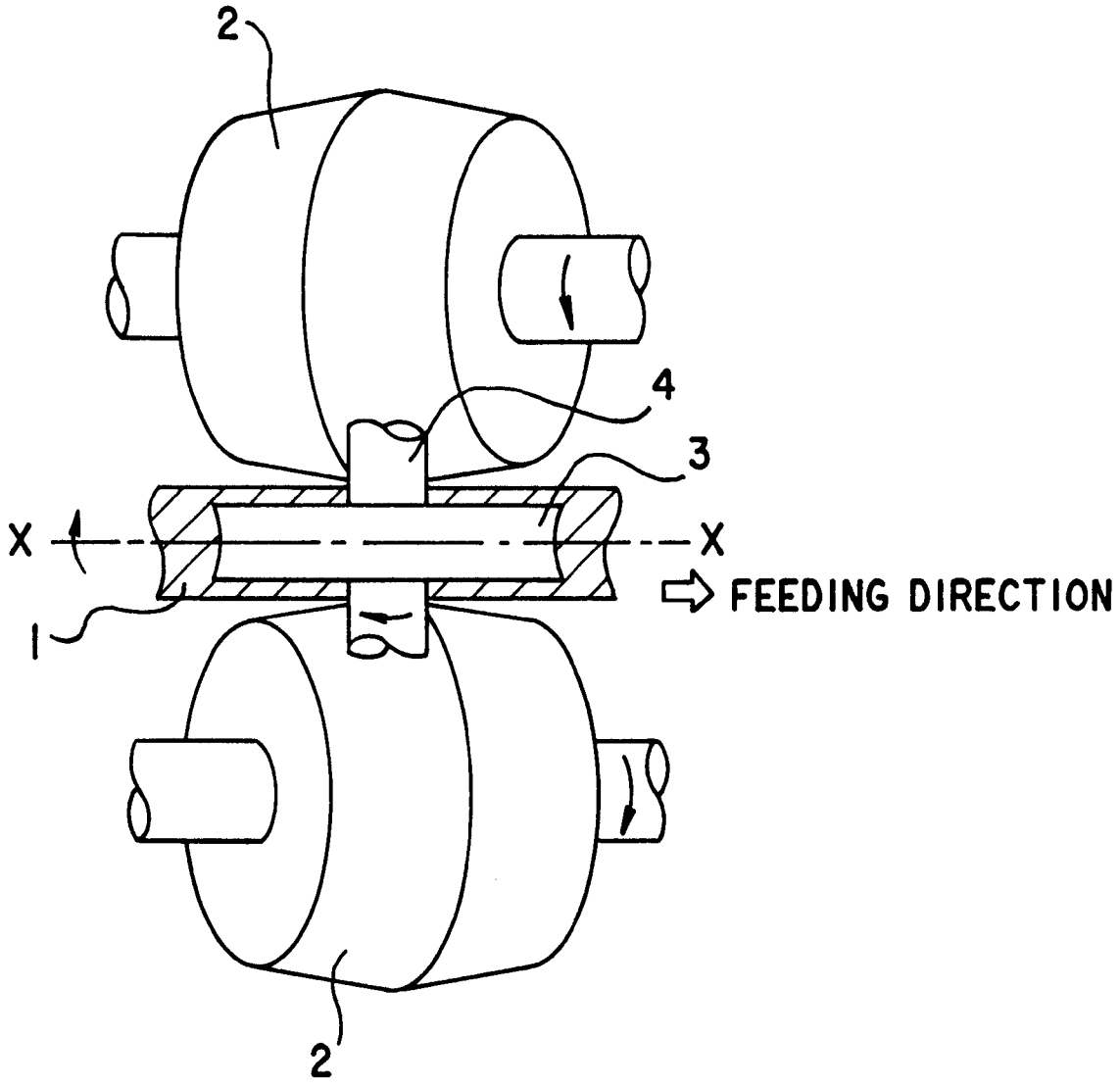
FIG. 1 (PRIOR ART)
FIG. 1 is a diagram explaining a state in which the material being pierced and an arrangement of piercing rolls and disk rolls in a piercing.

The piercer roll exchanging apparatus according to the present invention is mainly characterized by use of a traveling carrier car capable of moving, even while carrying upper and lower cradles thereon, between a traveling start position and a traveling end position close to a piercing mill body, and by a cradle shifter being mounted on the traveling carrier car, the cradle shifter being capable of shifting the upper and lower cradles from the traveling end position to the interior of the piercing mill body, the cradle shifter being provided with a spacer clamp for clamping the foregoing spacer and adjusting the vertical position of the spacer, and with a lower cradle clamp for clamping the lower cradle, the upper and lower cradles being stacked with the spacer sandwiched therebetween and moved horizontally and perpendicular to a pass line of a piece of tube stock to be subjected to piercing.

The piercer roll exchange method according to the present invention is used for the piercing mill exchanging apparatus of the above construction, in which method, when new piercer rolls are to be installed, a traveling carrier car carrying upper and lower cradles thereon is moved to a traveling end position, a cradle shifter shifts the upper and lower cradles to the interior of a piercing mill body, and the piercer rolls, which are accommodated within the cradles, are installed in the piercing mill body. In the piercer roll exchange method according to the present invention, when old piercer rolls are to be removed, the upper and lower cradles, while being held by the cradle shifter, are retreated from the position of the piercing mill body to the traveling end position, whereby the piercer rolls are removed. By combination of the piercer roll installation and removal methods, exchange of piercer rolls can be automated.

In the piercer roll exchanging apparatus and method according to the present invention, the cradles which accommodate piercer rolls are not replaced successively one by one, but the stacked upper and lower cradles are replaced together simultaneously, so that the time required for the piercer roll exchange work can be greatly shortened.

In the present invention, moreover, which premises the application thereof to a vertical piercing mill, the upper and lower cradles are drawn out horizontally and perpendicular to the pass line by use of a traveling carrier which is movable in the same direction. Therefore, the cradles can be immediately exposed to the exterior of the piercing mill body and hence the piercer roll exchange work can be performed in a simple manner. Also, no suspension means is required for raising and lowering the piercer rolls, and thus automation of the piercer roll exchange work can be easily attained.

Preferably, the traveling carrier car is of a structure such that a secondary carrier car can be carried thereon. If upper and lower cradles to be newly installed are loaded beforehand onto the secondary carrier car or if the upper and lower cradles removed from the piercing mill body are immediately loaded onto the traveling carrier, setup can be performed prior to installation of the new rolls for next preparation, and upon removal, the old rolls can be conveyed as they are up to a cradle storage area. Thus, use of suspension means such as an overhead traveling crane can be avoided not only in the area of the piercer roll exchange work but also in the storage area for the cradle.

Further, in the present invention a hook mechanism is preferably adopted as the lower cradle clamp. Through use of the hook mechanism, the traveling carrier car can reliably hold the lower cradle, and the upper and lower cradles can be kept stable on the carrier car even during traveling of the car. Additionally, when the piercer rolls are to be removed, removing the cradles from the piercing mill body becomes easy.

Specific examples of construction of the present invention, as well as the effects thereof, will be described in detail hereinafter with reference to FIGS. 2 to 6, in which common components are identified by like reference numerals.

Figure 2:
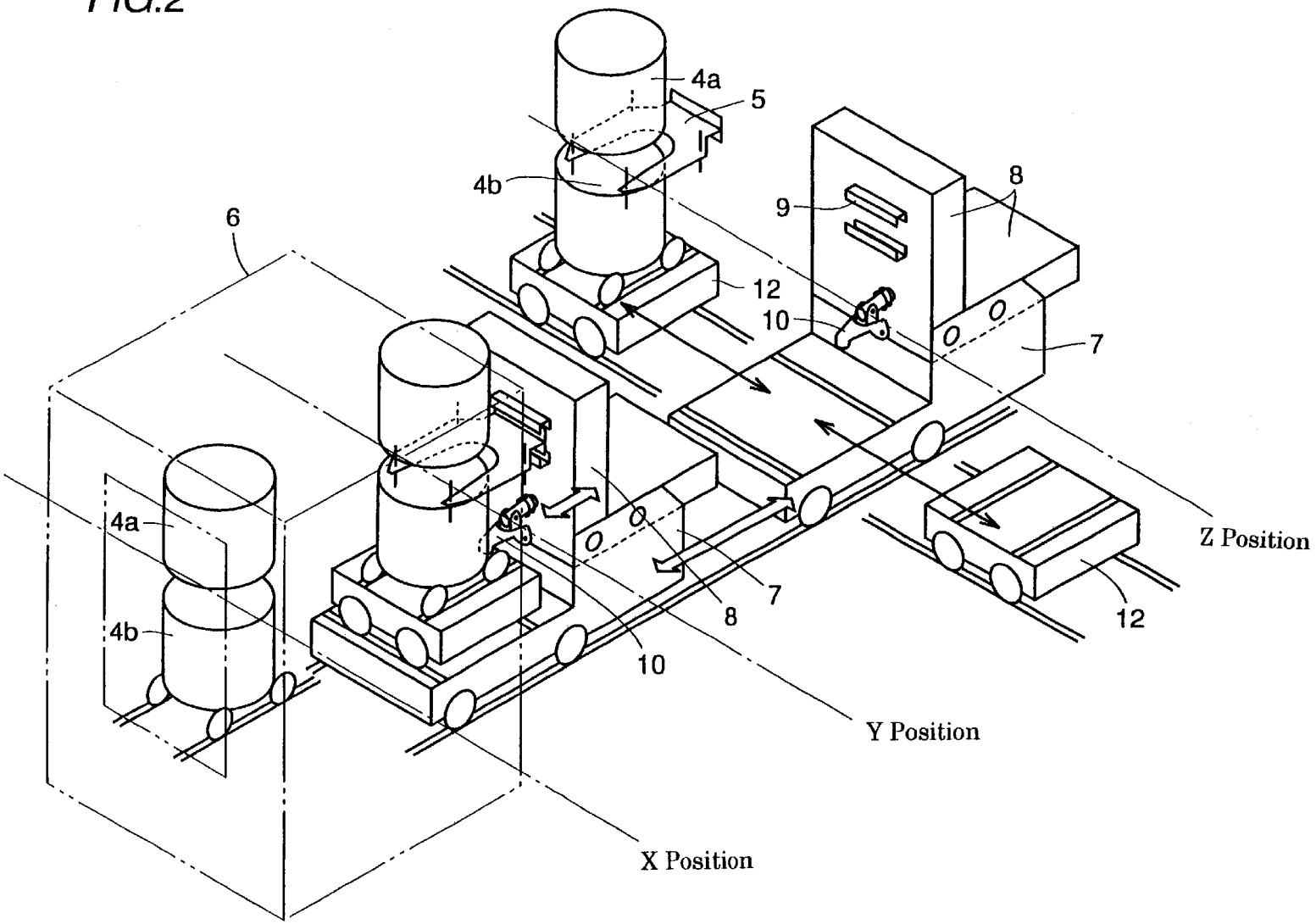
FIG. 2 is a diagram schematically showing an example of the overall construction of a piercer roll exchanging apparatus for use in a vertical piercing mill according to the present invention.

FIG. 2 is a diagram schematically showing an example of the overall construction of a piercer roll exchanging apparatus for use in a vertical piercing mill according to the present invention. In the vertical piercing mill, a pair of upper and lower piercer rolls are accommodated in an upper cradle 4*a* and a lower cradle 4*b*, respectively, which cradles are replaced in a stacked state on a traveling carrier car 7.

A cradle shifter 8 is mounted on the traveling carrier car 7. The upper and lower cradles 4*a*, 4*b* are held integrally with each other with a spacer 5 sandwiched therebetween, the spacer being held by a spacer clamp 9 provided in the cradle shifter 8.

The traveling carrier car 7, which is provided in the piercer roll exchanging apparatus, is adapted to move from a traveling start position (Z position) to a traveling end position (Y position). The traveling carrier car 7 is provided with the cradle shifter 8, which can shift the upper and lower cradles from the traveling end position (Y position) to a piercing mill body position (X position). The upper and lower cradles are moved to a central part of a mill housing 6. Further, as shown in the same figure, a secondary carrier car 12 capable of carrying the cradles thereon may be loaded onto and unloaded from the traveling carrier car at the traveling start position (Z position).

Figure 3:
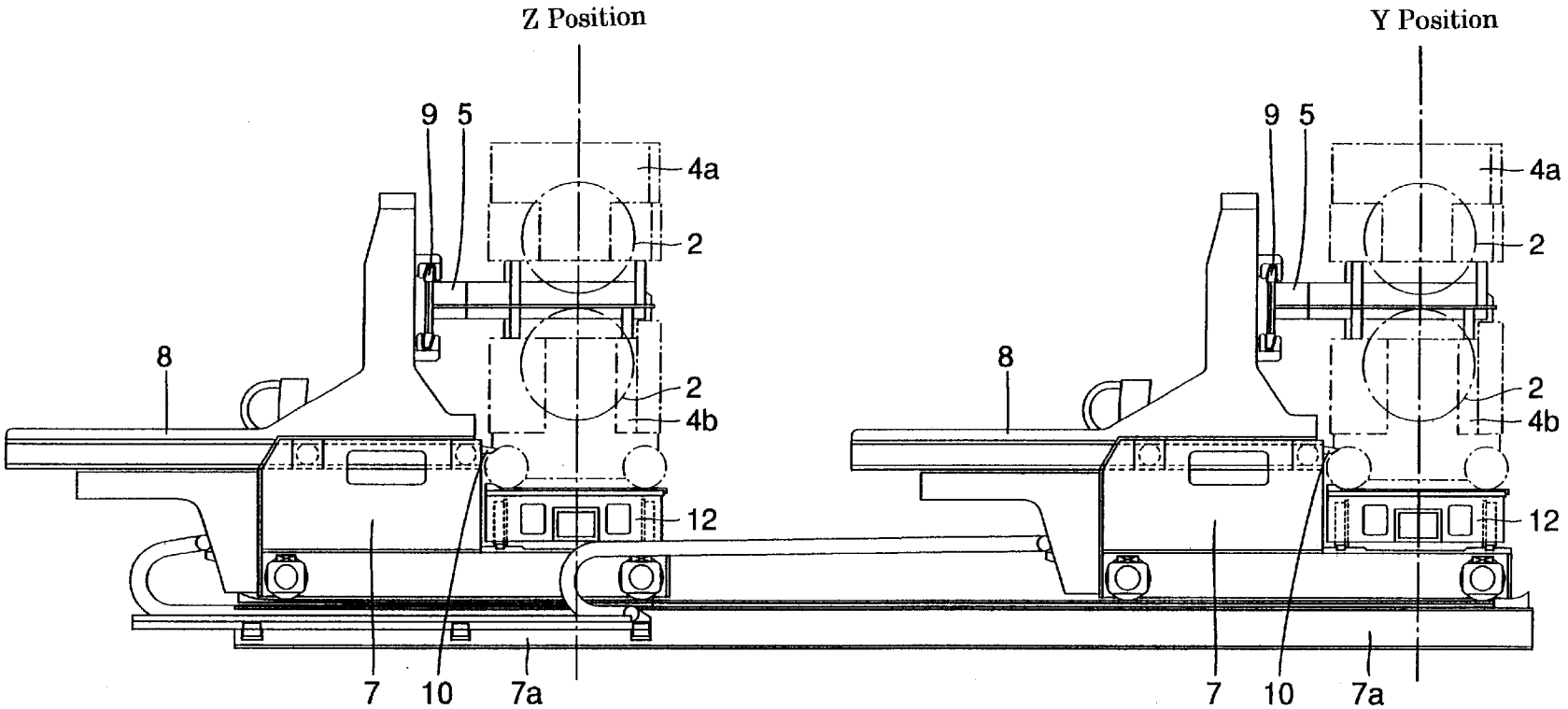
FIG. 3 is a diagram showing a state in which a traveling carrier car travels from a traveling start position (Z position) to a traveling end position (Y position)

FIG. 3 is a diagram showing a state in which the traveling carrier car moves from the traveling start position (Z position) to the traveling end position (Y position). In the same figure, the left-hand side shows a state at the traveling start position (Z position), and the right-hand side shows a state at the traveling end position (Y position). In the present invention, the traveling carrier car 7 is driven by an electric motor and travels on carrier car rails 7*a*, then stops at the traveling start position (Z position) or at the traveling end position (Y position). Though not shown, a carrier car stop position-fixing device is preferably disposed at the stop position for the purpose of fixing the traveling carrier car 7 onto the rails 7*a*.

As shown in FIG. 3, the upper and lower cradles 4*a*, 4*b*, which accommodate respective piercer rolls 2, are stacked one above the other, with the spacing between the two cradles being adjusted by the spacer 5. The spacer B is held by the spacer damp 9 provided in the cradle shifter 8 and its height is switched between an illustrated reference position and a higher, raised position, as will be described later.

The cradles loaded onto the traveling carrier car are fixed by means of a lower cradle damp 10. A specific example of a damp is a hook mechanism attached to the front end of the cradle shifter 8. As shown in FIG. 3, the secondary carrier car 12 is carried on the traveling carrier car 7, and the upper and lower cradles 4*a*, 4*b* are loaded onto the secondary carrier car 12. The secondary carrier car 12 carrying the upper and lower cradles thereon is loaded onto and unloaded from the traveling carrier car 7 at the traveling start position (Z position).

Figure 4:
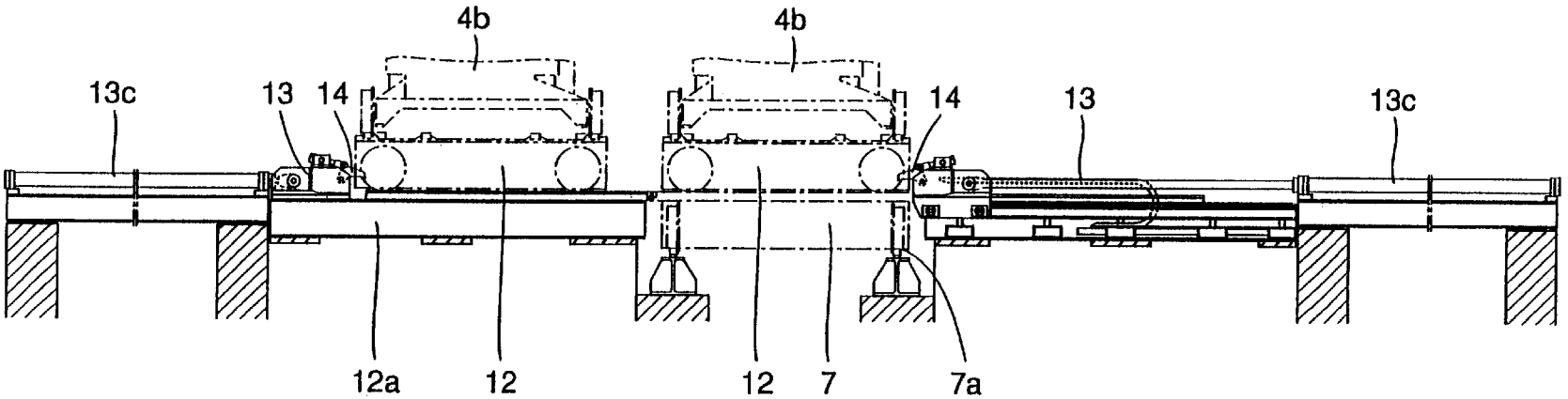
FIG. 4 is a diagram showing a state in which a secondary carrier car is loaded onto and unloaded from the traveling carrier car at the traveling start position (Z position)

FIG. 4 is a diagram showing a state in which the secondary traveling car is loaded onto the traveling carrier car at the traveling start position (Z position), the carrier car moving in the direction perpendicular to the plane of the paper. At the traveling start position (Z position), secondary carrier car retractors 13 are disposed on the right and left sides of the traveling carrier car 7, for the purpose of loading onto and unloading from the traveling carrier car a secondary carrier car 12 which carries thereon a cradle 4*b* to be newly installed in the piercing mill body, or a secondary carrier car 12 which carries thereon a cradle 4*b* removed from the piercing mill body.

The secondary carrier car 12 is adapted to move on secondary carrier car rails 12*a*, with rails for resting the secondary carrier car 12 thereon also being provided on the traveling carrier car 7. For loading or unloading the secondary carrier car to or from the traveling carrier car, a secondary carrier car damp 14 mounted at the tip of the secondary carrier car retractor 13 is actuated so as to hold the secondary carrier car 12 firmly. Thereafter, a cylinder 13*c* for the secondary carrier car retractor is actuated forward or backward so as to load the secondary carrier car 12 onto the traveling carrier car 7 or unload the same therefrom. Subsequently, the clamping force of the secondary carrier car clamp 14 is relieved. When the cradles are loaded onto the secondary carrier car 12, the cradles are preferably fixed onto the same car by means of an unillustrated cradle clamp.

Figure 5:
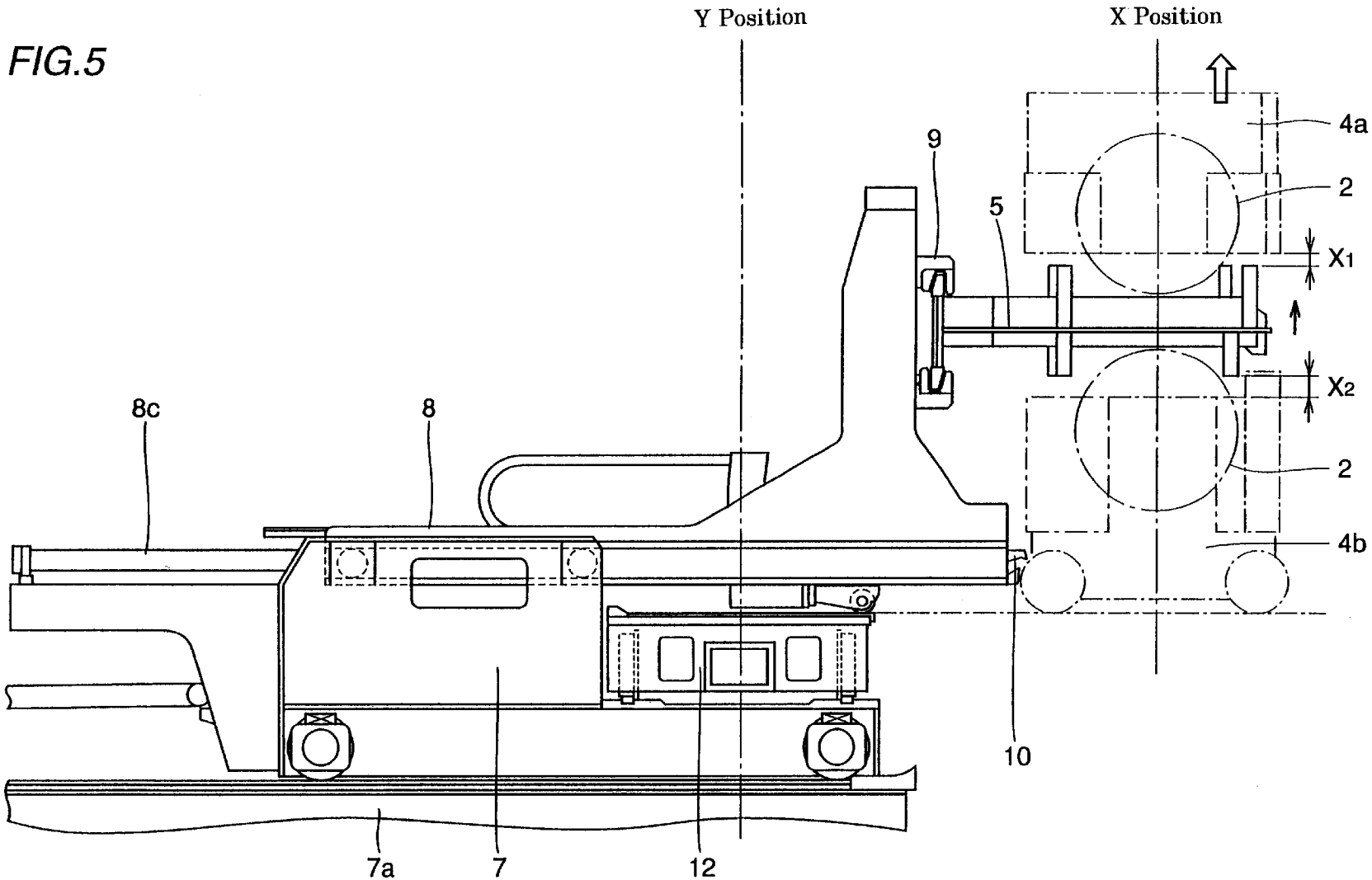
FIG. 5 is a diagram showing a state in which, after the traveling carrier car is stopped at the traveling end position (Y position), upper and lower cradles are moved to a piercing mill body position (X position) by a cradle shifter.

FIG. 5 shows a state in which, after the traveling carrier car is stopped at the traveling end position (Y position), the cradle shifter shifts the upper and lower cradles to the piercing mill body position (X position). When the traveling carrier car 7 stops at the traveling end position (Y position), the traveling carrier car is preferably fixed onto the carrier car rails 7*a* by operation of a carrier car stop position fixing device. In the case where the cradles on the secondary carrier car 12 are fixed to the same car by means of a cradle clamp, the damping force of the damp is relieved. Subsequently, the cradle shifter 8 advances by operation of a shifter cylinder 8*c*, so that the stacked cradles enter the piercing mill body. In this connection, wheels are attached to the lower cradle in order to effect smooth shifting of the cradles, and rails for the wheels are laid on the secondary carrier car and in the interior of the piercing mill body.

When the upper and lower cradles 4*a*, 4*b* have moved to the piercing mill body position (X position); that is, to the center of the pass line of the material to be rolled, the upper cradle 4*a* is raised by employment of, for example, the mechanism of a screw-down device of the piercing mill, and the spacer 5 held by the spacer damp 9 is then lifted by only a predetermined vertical distance so to avoid interference between the spacer 5 and the lower cradle 4*b*. More specifically, as shown in FIG. 5, a spacing $X_1$ is ensured between the upper cradle 4*a* and the spacer 5, while a spacing $X_2$ is ensured between the lower cradle 4*b* and the spacer 5. In this state, the lower cradle clamp 10 attached to the front end of the traveling carrier car 7 is opened so as to effect undamping of the lower cradle 4*b*.

The upper and lower cradles are allowed to remain in the piercing mill body position (X position), and the traveling carrier car 7 retreats to the traveling end position (Y position) while holding the spacer 5. By this operation, the cradles, which accommodate new piercer rolls, can be installed in the piercing mill body.

Figure 6:
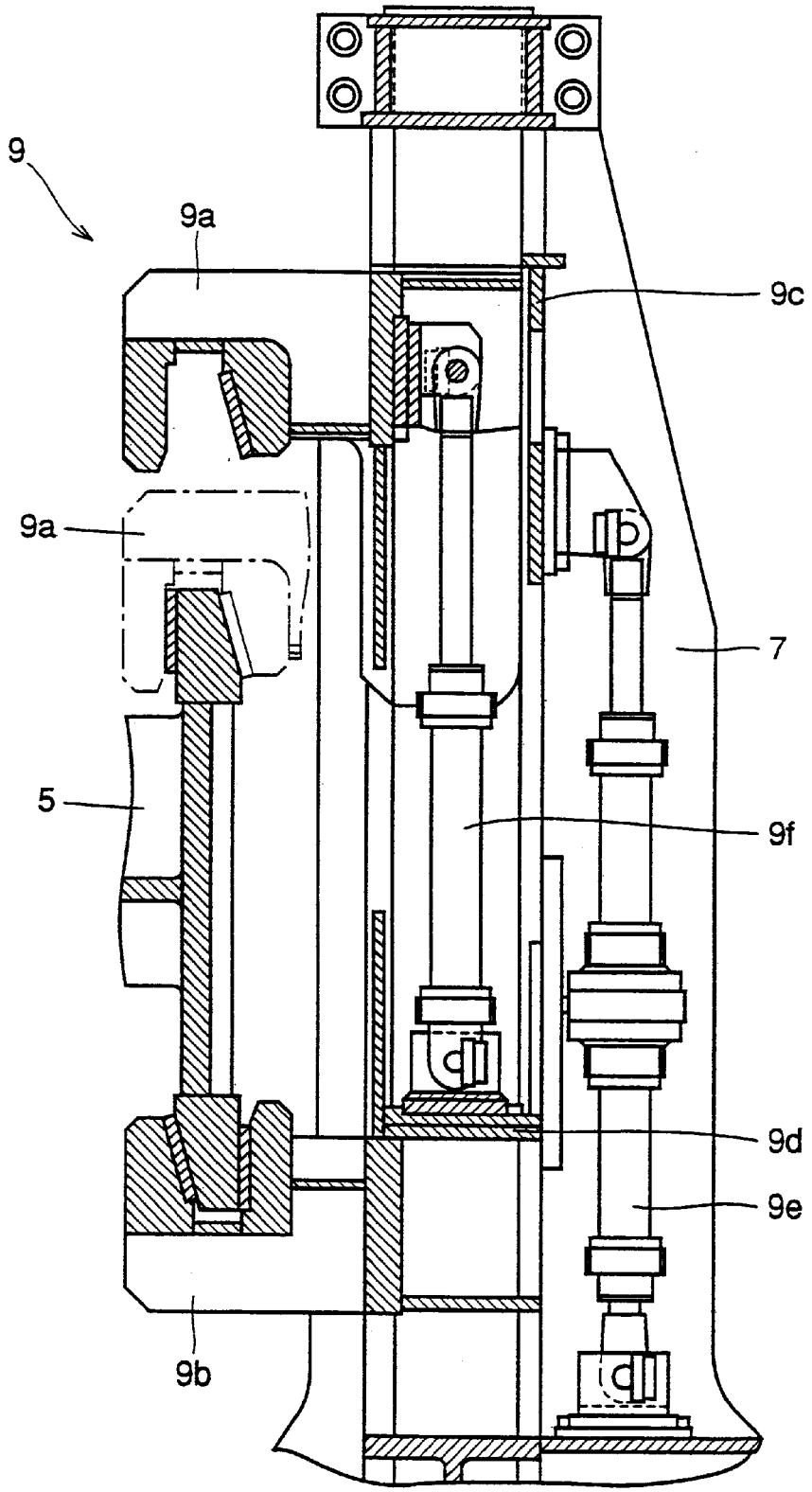
FIG. 6 is a diagram showing a structure for changing the vertical position of a spacer by use of a spacer damp.

FIG. 6 illustrates the structure of the spacer clamp for changing the vertical position of the spacer. As noted previously, the spacer damp 9 is mounted on the surface of the cradle shifter 8 disposed opposite the piercing mill. The spacer clamp 9 must function to change the position of the spacer 5 to its raised position from its reference position so as adjust the spacing between the upper and lower cradles and must unclamp the spacer. To realize these functions and operations, the spacer damp 9 comprises an upper damp 9*a* mounted on an upper slide frame 9*c*, and a lower damp 9*b* mounted on a lower slide frame 9*d*. In order to enable these upper and lower damps to move vertically in an independent or integral manner, an upper clamp lift cylinder 9*e* and a lower damp lift cylinder 9*f* are provided through the upper slide frame 9*c*. By adoption of such a structure, the upper clamp 9*a* can select two positions in accordance with operation of the upper clamp lift cylinder 9*e*. Further, when this structure is combined with the operation of the lower clamp lift cylinder 9*f*, the lower clamp 9*b* can select three positions.

More specifically, when the spacer 5 is to be held at its reference position, the upper and lower damp lift cylinders 9*e*, 9*f* are brought into a contracted state, whereas when the spacer 5 is to be shifted to its raised position, only the upper clamp lift cylinder 9*e* is brought into an extended state, thereby causing the spacer 5 to rise. Thereafter, the lower clamp lift cylinder 9*f* is brought into an extended state, whereby the spacer 5 can be unclamped. In FIG. 6, a broken line shows the state in which the upper damp 9*a* damps the spacer, whereas a solid line shows the state in which the upper clamp 9*a* undamps the spacer.

The above description relates to installation of piercer rolls in the piercing mill body. However, the present invention is to be understood as also encompassing a piercer roll exchange method for use in removing piercer rolls from a piercing mill. Removal of piercer rolls can be effected by reversing the above operational procedure.

INDUSTRIAL APPLICABILITY

According to the piercer roll exchanging apparatus and method of the present invention, as set forth hereinabove, use of suspension means, such as an overhead traveling crane, which has presented problems in the conventional piercer roll exchange, is not required. Further, piercer roll exchange work can be automated by employment of a simple structure, thereby shortening the time required for the same, and flexible manufacture of small quantities of seamless steel tubes of a variety of different sizes can be attained.

Thus, the piercer roll exchanging apparatus and method of the present invention are widely applicable to the field of manufacture of seamless steel tubes so as to improve manufacturing efficiency, without deteriorating workability.

What is claimed is:

1. A piercer roll exchanging apparatus for use in a vertical piercing mill for replacing a pair of piercer rolls together with upper and lower cradles which accommodate the respective piercer rolls, and a spacer which adjusts the spacing between said upper and lower cradles, said paired piercer rolls being disposed one above the other and opposed to each other with respect to a pass line of a material to be rolled to piercing, the piercer roll exchanging apparatus comprising:

a traveling carrier car operable to move between a traveling start position and a traveling end position close to a piercing mill body, and a cradle shifter carried on said traveling carrier car, said cradle shifter being operable for shifting said upper and lower cradles from said traveling end position to the interior of said piercing mill body, said cradle shifter being provided with a spacer clamp for clamping said spacer and for adjusting the vertical position of the spacer, and with a lower cradle clamp for clamping said lower cradle, said upper and lower cradles being stacked with said spacer being sandwiched therebetween and being movable horizontally and perpendicular to said pass line.

2. A piercer roll exchanging apparatus for use in a vertical piercing mill according to claim 1, wherein the traveling carrier car has a structure for carrying thereon a secondary carrier car which carries thereon cradles accommodating piercer rolls to be newly installed in said piercing mill body, or a secondary carrier car which carries thereon cradles accommodating piercer rolls removed from the piercing mill body, and such that there is provided a secondary carrier car retractor operable for loading and unloading the secondary carrier car onto and from said traveling carrier car at said traveling start position.

3. A piercer roll exchanging apparatus for use in a vertical piercing mill according to claim 1, wherein said lower cradle clamp is a hook mechanism.

4. A piercer roll exchanging method for use in a vertical piercing mill for exchanging a pair of piercer rolls together with cradles which comprise an upper cradle and a lower cradle stacked on said upper cradle and which accommodate the respective piercer rolls, together with a spacer which adjusts the spacing between said upper and lower cradles, said paired piercer rolls being disposed one above the other and opposite each other with respect to a pass line of a material to be rolled to piercing, the piercer roll exchanging method comprising the steps of:

loading said upper and lower cradles onto a traveling carrier car at a traveling start position;

moving said traveling carrier car to a traveling end position while allowing a cradle shifter to clamp said spacer;

causing said cradle shifter to shift said upper and lower cradles to the interior of a piercing mill body in order to install said piercer rolls in said piercing mill body as they are accommodated in said cradles; and retracting said cradle shifter which clamps said spacer, whereby said piercer rolls are installed,.

5. A piercer roll exchanging method for use in a vertical piercing mill for exchanging a pair of piercer rolls together with cradles which comprise an upper cradle and a lower cradle stacked on said upper cradle and which accommodate the respective piercer rolls, together with a spacer which adjusts the spacing between said upper and lower cradles, said paired piercer rolls being disposed one above the other and opposite each other with respect to a pass line of a material to be rolled to piercing, the piercer roll exchanging method comprising the steps of:

moving a traveling carrier car to a traveling end position while allowing said spacer to be clamped by means of a cradle shifter;

causing said cradle shifter to move said spacer to the interior of a piercing mill body in order to remove said piercer rolls from said piercing mill body as they are accommodated in said cradles; and causing said cradle shifter to retreat said stacked upper and lower cradles and said spacer, whereby said piercer rolls are removed.

6. A piercer roll exchanging method for use in a vertical piercing mill according to claim 4, including the steps of: providing a secondary carrier car; stacking said upper and lower cradles on said secondary carrier car with said spacer sandwiched therebetween; and loading and unloading said secondary carrier car with respect to said traveling carrier car at the traveling start position.

7. A piercer roll exchanging method for use in a vertical piercing mill according to claim 5, including the steps of: providing a secondary carrier car; stacking said upper and lower cradles on said secondary carrier car with said spacer sandwiched therebetween; and loading and unloading said secondary carrier car with respect to said traveling carrier car at the traveling start position.

* * * * *